US005800125A

United States Patent [19]

Largillier et al.

[11] Patent Number: 5,800,125

[45] Date of Patent: Sep. 1, 1998

[54] TURBINE DISK COOLING DEVICE

[75] Inventors: Christian Largillier, Le Mee sur Seine; Marc Roger Marchi, Le Mee; Laurent Palmisano, Yerres; Gérard Jacques Stangalini, Fontainebleau, all of France

[73] Assignee: Societe Nationale D'Etude et de Construction de Moteurs D'Aviation "Snecma", Paris, France

[21] Appl. No.: 779,438

[22] Filed: Jan. 7, 1997

[30] Foreign Application Priority Data

Jan. 18, 1996 [FR] France ..... 96 00521

[51] Int. Cl.[6] ..... F04D 29/58

[52] U.S. Cl. ..... 416/96 R

[58] Field of Search ..... 416/95, 96 R

[56] References Cited

U.S. PATENT DOCUMENTS 5,402,636 4/1995 Mize et al. .

FOREIGN PATENT DOCUMENTS

| | | |
|---|---|---|
| 2 292 868 | 6/1976 | France . |
| 2 439 872 | 5/1980 | France . |
| 2 042 643 | 9/1980 | United Kingdom . |
| 2 135 394 | 8/1984 | United Kingdom . |
| 2 184 167 | 6/1987 | United Kingdom . |
| 2 266 345 | 10/1993 | United Kingdom . |

*Primary Examiner*—John T. Kwon

*Attorney, Agent, or Firm*—Oblon, Spivak, McClelland, Maier & Neustadt, P.C.

[57] ABSTRACT

Device for cooling the external part of a turbine disk (2) by means of an external fresh air current (circuit II) without mixing with the warmer ventilation from the center of the disk (circuit I). A part (30) through which ducts (31, 32) pass that intersect without interruption, prevents mixing of substantially perpendicular streams in front of a part (22) of the disk (2) and a mixture which reduces the cooling efficiency.

6 Claims, 3 Drawing Sheets

FIG. 2
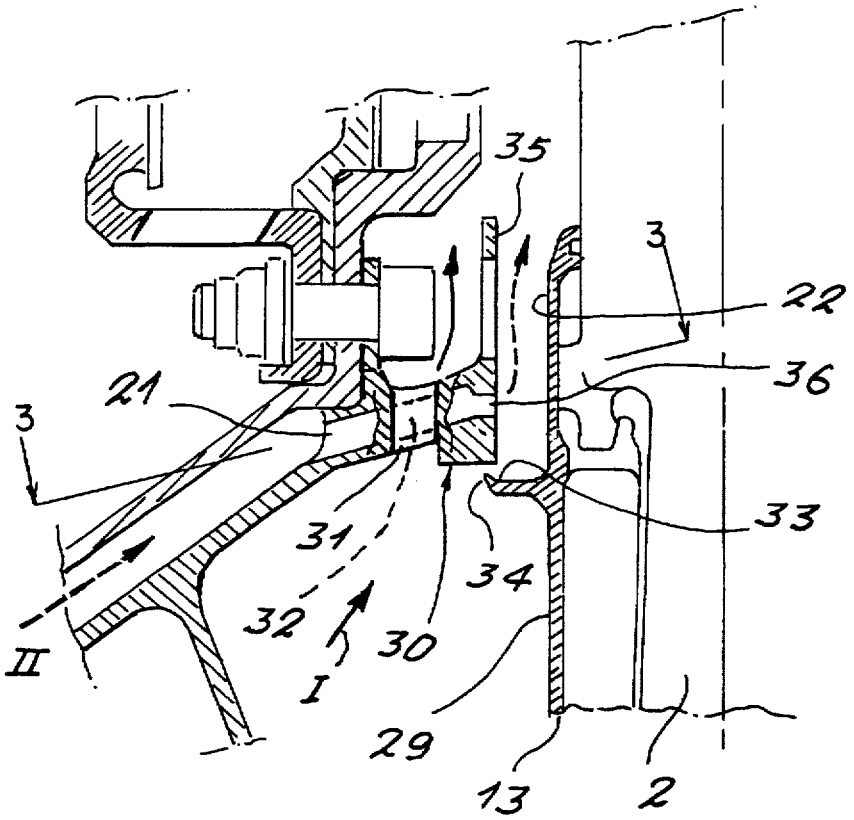
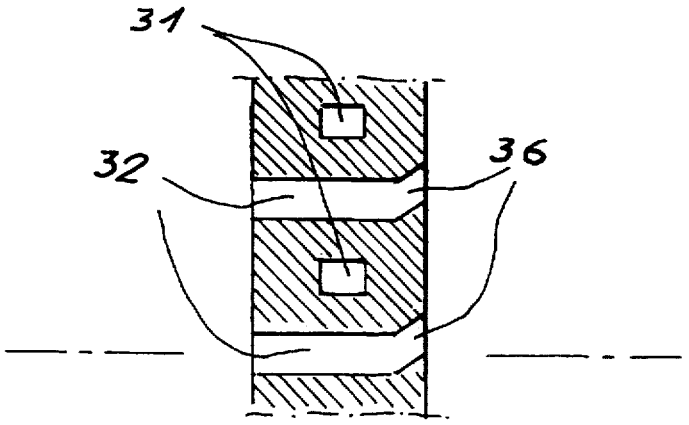
FIG. 3

TURBINE DISK COOLING DEVICE

DESCRIPTION

The invention relates to a turbine disk cooling device.

Figure 1:
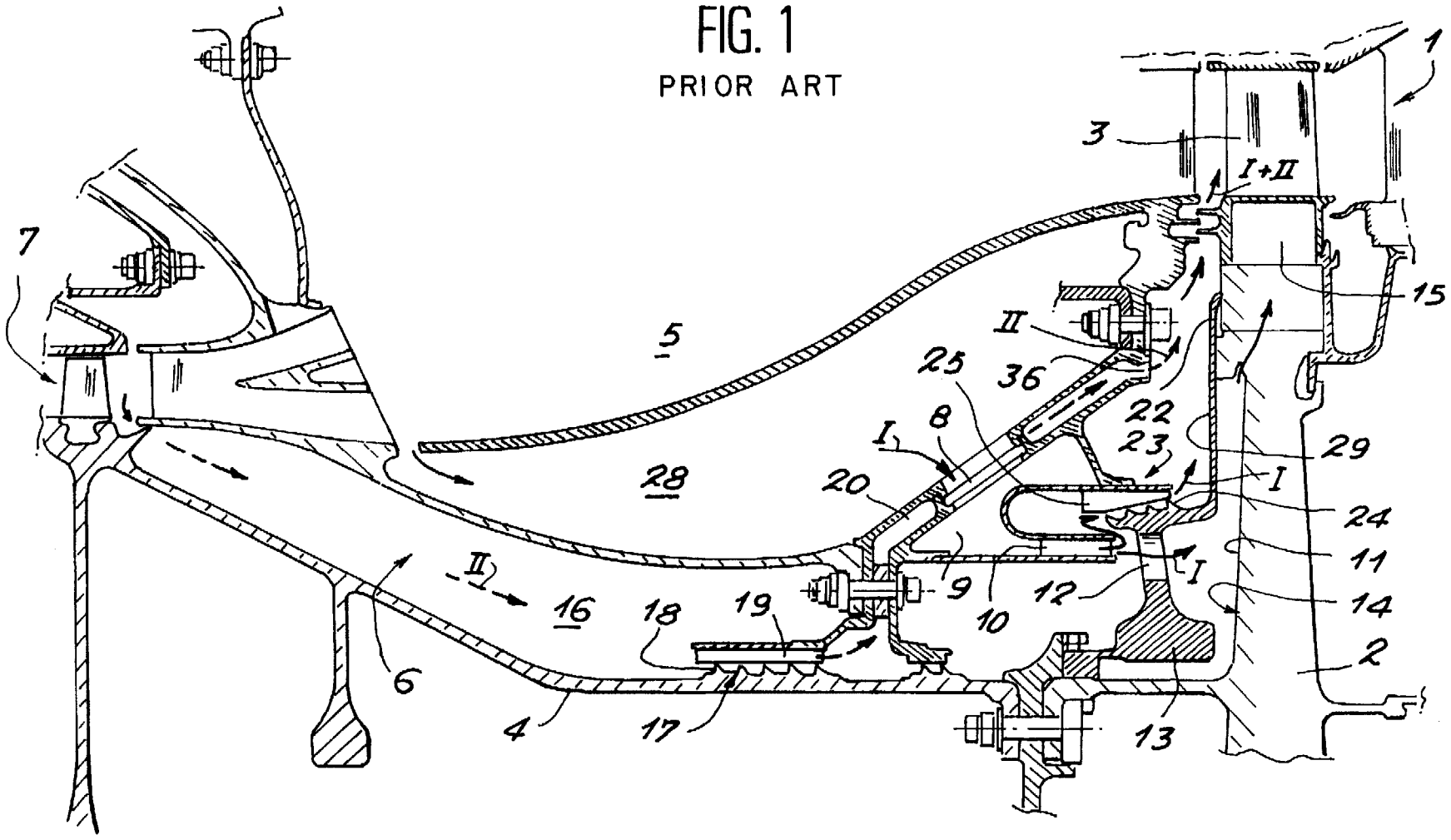
FIG. 1 PRIOR ART

In the gas turbine part of an existing machine illustrated in FIG. 1, the high pressure turbine 1 starts at a disk 2 carrying a first mobile blade stage 3 and fixed to the rotor 4. This disk 2 is located on the downstream side of a combustion chamber 5 formed in a stator 6 surrounding rotor 4 and which is itself located on the downstream side of a high pressure compressor 7.

The gases resulting from the combustion of fuel in chamber 5 very strongly heat disk 2, which then has to be efficiently cooled to maintain the material of which it is composed to a temperature consistent with maintaining its mechanical strength properties. The method used consists of two ventilation circuits I and II of cooler air: the first of them, I, illustrated by the solid arrows, uses air drawn off immediately ahead of the combustion chamber 5 and which passes through a rear chamber 28 before leaving it through orifices 8 to penetrate into injection chambers 9 from which air exits through high pressure injectors 10 which accelerate and force it out at high speed towards the side 14 of disk 2.

Some of this air actually reaches an inner ring 11 forming part of side 14, after passing through orifices 12 in a flange 13 covering the disk 2, and then rotation of disk 2 creates a centrifugal force on the air flow that forces it outwards; air is guided between the surface of the side 14 of disk 2 and the flange 13, finally cooling the periphery of disk 2 by entering into the cavities 15 formed in it.

The second air flow II illustrated by the arrows in dashed lines, is taken off just after the high pressure compressor 7 and passes through a chamber 16 formed between the rotor 4 and the stator 6, from which it leaves through a labyrinth or brush seal 17 placed between these parts and composed more precisely of lip seals 18, i.e. circular ridges erected on rotor 4 which rub on a wearing material 19 fixed to stator 6, i.e. made of a soft material in which they form recesses as a function of differential expansions at the various machine speeds. The air pressure forces air outside the chamber 16 and into an annular and divergent guide duct 20, contiguous with part of the bottom of the chamber 28 over a large part of its length and from which air exits through upper injectors 36 which lead into an external radial ring 22 of the turbine disk 2, actually forming part of the surface of side 29 of flange 13 rigidly attached to this disk.

The air in the second ventilation circuit significantly cools the external ring 22, by coming into contact with this area close to the combustion gases and therefore heated to a higher temperature. The need to cool the entire disk 2, and particularly its periphery, justifies the doubling up of cooling circuits, which use air that may originate from other parts of the machine. However, the design is such that part of the air in the first ventilation circuit does not pass through orifices 12, but instead bypasses flange 13 on the outside and passes through a labyrinth or brush seal 23, fairly similar to the previous seal 17 and, like it, composed of lipseals 24 erected on the side flange 13, and a layer of wearing material 25 welded to a surface of the stator 6. The centrifugal forces exerted by the flange 13 on this portion of the first flow straighten it like the previous portion and force it along the surface of side 29 until it finally intersects the flow in the second ventilation circuit in front of the outer ring 22.

The origin of the invention is based on the observation that this situation is not ideal, since the air flow from circuit I is significantly warmer than the air flow from circuit II (about 50° C.).

British patents 2,135,394 and 2,184,167 describe devices similar to that shown in FIG. 1, in particular including a double cooling circuit by air circulation, but which also have larger differences: thus the air in circuit II is the hottest part, and no longer cools the disk but instead cools parts of the rotor and stator adjacent to chamber 16.

The invention consists of adding parts with the function of directing flows to prevent them from being mixed, so that the air in circuit II originating from the upper injectors 36 reaches the outer ring 22 without going past obstacles; this air in circuit II is significantly cooler than the air in circuit I, since the labyrinth or brush seal 17 associated with it heats the air less than the larger diameter labyrinth seal 23, and the air in the first circuit I is centrifuged at the outlet from labyrinth 23, and therefore compressed which also heats it.

This increased cooling due to second circuit air largely compensates the loss of cooling following the temporary diversion of the air stream from the first flow, which has less action.

Therefore in its most general form, the invention consists of a cooling device for a turbine disk covered by a flange comprising a first and a second ventilation circuit using air originating from a stator and flowing out in front of an inner ring in the disk, and an outer ring radial to the flange, respectively, part of the first circuit forking to a seal placed between the flange and the stator, then in front of the flange and parallel to the flange, towards the flange outer ring, characterized in that it comprises a part located in front of the outer ring, crossed by first ducts approximately parallel to a surface of the side of the flange and forming an extension to the first ventilation circuit, and second ducts forming an extension to the second ventilation circuit, intersecting but not interrupting the first ducts, and terminating in front of the outer ring.

Other features of the invention will be more easily understood by reading the following detailed description of one of its implementations, with reference to the following Figures:

FIG. 1 described above, illustrates a previously known design for gas turbines to which the invention can also be applied;

FIGS. 2 and 3 illustrate the invention,

FIG. 3 being a section along line A—A in FIG. 2, and

Figure 4:
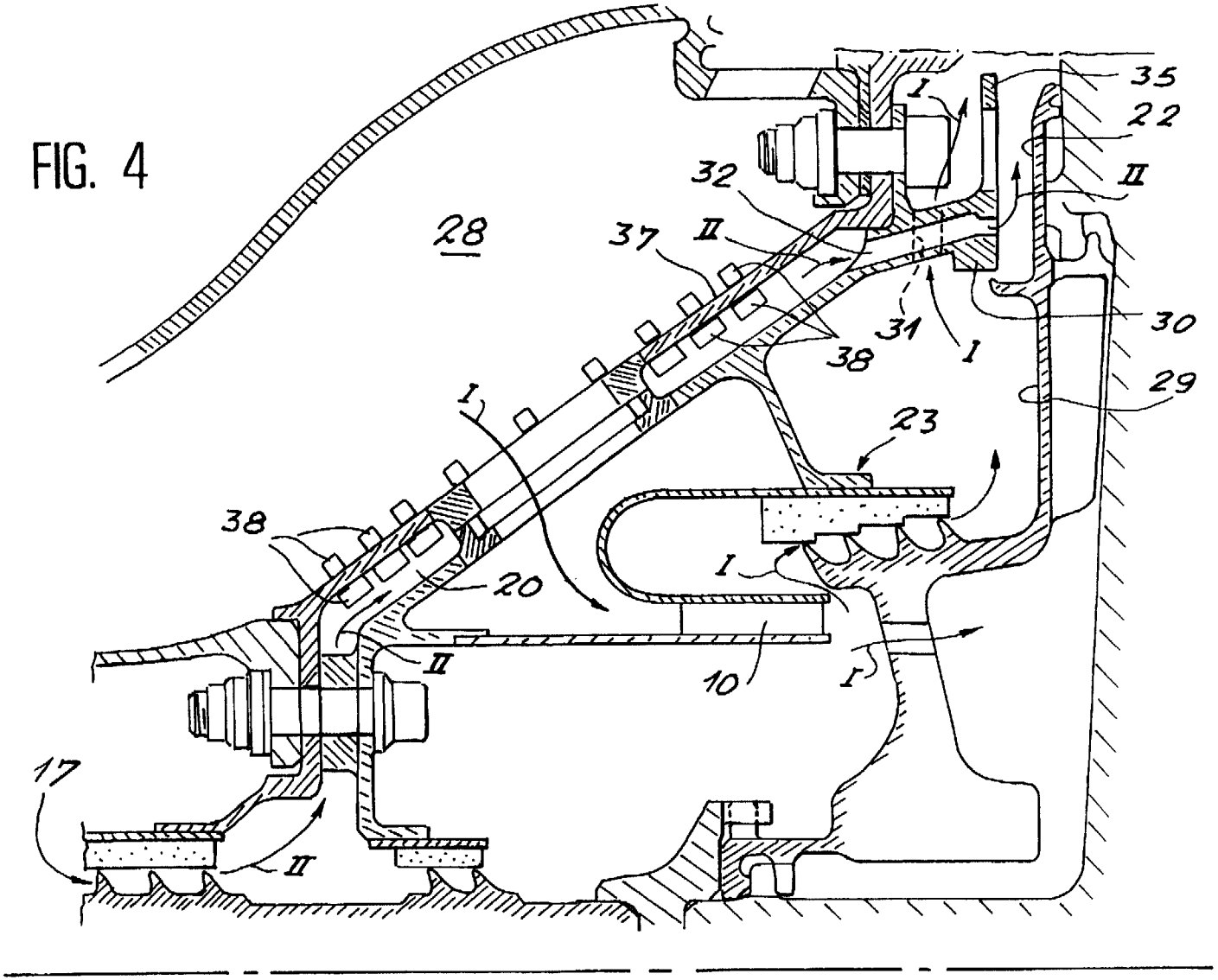

FIG. 4 is a cross-sectional view of a turbine machine including an alternative embodiment according to the present invention.

The fundamental element of the invention represented in FIG. 2 is a distributing ring 30 rigidly attached to stator 6 and located immediately in front of outer ring 22 to be cooled, at a short distance from it and not separated from it by any obstacle. Axial ducts 32 pass through the distributing ring 30, and form an extension to the upper injectors 36 to terminate in front of the outer ring 22, and ducts 32 are separated by substantially radial ducts 31 which intersect but do not interrupt the first ducts, as shown in the sectional detail in FIG. 3.

The inside of the distribution ring 30 is laid out to minimize pressure losses; thus the axial ducts 32 may be connected to slanting injectors 36, facing the direction of motion of disk 2.

Ventilation air in the second circuit II travels along axial ducts 32, and therefore is not affected by the air in circuit I which passes through radial ducts 31; the mixture of flows only takes place at the periphery of disk 2 beyond the outer ring 22. To further reduce mixing opportunities, the flange 13 can be made with a lip seal 33 on the side surface 14, in other words a ridge the free end of which 34 just comes into contact with the distributing ring 30 and which has the purpose of guiding air in stream I along the surface of the side 29 of flange 13 towards radial ducts 31, without allowing it to slide as far as the outer ring 22. In the embodiment shown in which part of the distributing ring 30 in which ducts 31 and 32 are formed extends in front of a portion radially inside external ring 22, and a screen 35 parallel to the outer ring 22 can be added to the distributing ring 30, extending in front of the remainder of the outer ring, to separate the streams in the two circuits by force, until beyond the outer ring 22. The intersection of circuits I and II essential for cooling of disk 2 should be distinguished from their previous intersection at the location of the orifices 8, which obviously does not perform the same function.

Now refer to FIG. 4, it can be seen that the efficiency of the invention is further improved if the cooler air in the second circuit II is cooled even more. The air in the first circuit is used for this purpose, which is temporarily cooler before it passes through the high pressure injectors 10 and the labyrinth or brush seal 23 and after the air in the second circuit has passed its labyrinth or brush seal 17. The streams are partly contiguous in this state, since they then circulate in the rear chamber 28 and the divergent duct 20 which are only separated by a fairly thin partition 37 in the stator casing 6. Obstacles 38 such as ribs, bossings or corrugations on the two sides of this partition 37 can then be used to improve heat exchange between the two streams.

The temperature of the turbine disk 2 is increased to above 650° C. in the known machine. Use of the invention can reduce this temperature for flange 13 by several tens of degrees. This is a major improvement considering the high quality already achieved with existing engines; it may be implemented using less expensive materials to make disk 2 and its flange 13, or by reducing cooling flows.

We claim:

1. Cooling device for a turbine disk comprising:

a first and a second cooling flow path originating from a stator and leading in front of an inner ring in a turbine disk and an outer ring in a flange respectively, wherein a portion of the first path is separated and directed to a seal placed along the first path, then in front of the flange and parallel to the flange to the outer ring of the flange;

a part located in front of the outer ring;

a plurality of first ducts which pass through said p approximately parallel to a surface of a side of the flange, said first ducts forming an extension to the first cooling flow path;

a plurality of second ducts which pass through said part forming an extension to the second cooling flow path, intersecting but not interrupting the first ducts, and terminating in front of the outer ring.

2. Cooling device for a turbine disk in accordance with claim 1, wherein the flange comprises a guide part configured to guide an air stream originating from the first cooling flow path passing along the surface of the side of the flange to the first ducts.

3. Cooling device for a turbine disk in accordance with claim 2, wherein the guide part is a lipped edge contacting said part through which the ducts pass, sad lip being rigidly attached to the stator.

4. Cooling device for a turbine disk in accordance with claim 1, wherein said part through which the ducts pass includes a screen parallel to the outer ring and located between said outer ring and the first ducts.

5. Cooling device for a turbine disk in accordance with claim 4, wherein the first ducts and the screen extend in front of radial portions radially inside and outside the outer ring, respectively.

6. Cooling device for a turbine disk in accordance with claim 1, wherein the first cooling flow path includes a labyrynth or brush seal and the second cooling flow path includes a second labyrynth seal and wherein the first and second cooling flow paths have contiguous portions on the downstream side of the second labyrinth or brush seal and on the upstream side of the first labyrinth or brush seal, the labyrinth seals being placed within the cooling paths wherein obstacles are mounted within the contiguous portions to improve heat exchange between the cooling flow paths.

* * * * *